United States Patent [19]

Atwell et al.

[11] 4,069,930

[45] Jan. 24, 1978

[54] APPARATUS FOR HANDLING ROD-SHAPED ARTICLES

[75] Inventors: Charles Gary Atwell, Mechanicsville; Steven F. Spiers; William H. Smick, III, both of Richmond, all of Va.

[73] Assignee: Philip Morris Incorporated, New York, N.Y.

[21] Appl. No.: 676,106

[22] Filed: Apr. 12, 1976

[51] Int. Cl.[2] ..... B65G 47/52

[52] U.S. Cl. ..... 214/302; 198/533; 214/307; 214/314

[58] Field of Search ..... 198/533; 221/200, 201; 222/200; 259/47, 27; 53/148, 236; 214/302, 307, 308, 314, 304

[56] References Cited

U.S. PATENT DOCUMENTS

| | | | |
|---|---|---|---|
| 2,605,909 | 8/1952 | Molins et al. | 214/301 |
| 2,924,356 | 2/1960 | Pollmann et al. | 221/201 |
| 2,942,757 | 6/1960 | Pollmann | 221/201 |
| 3,486,647 | 12/1969 | Seragnoli | 214/302 |
| 3,718,224 | 2/1973 | Hilman | 214/302 |
| 3,976,085 | 8/1976 | Hall | 53/148 |
| 4,008,555 | 2/1977 | Alnoya et al. | 53/148 |

*Primary Examiner*—Lawrence J. Oresky
*Attorney, Agent, or Firm*—Watson, Leavenworth, Kelton & Taggart

[57] ABSTRACT

Apparatus for maintaining suitable profiles of rod-shaped articles contained in a hopper includes an agitator translatable in the hopper in the direction of movement of conveyors fed by the hopper. A detector unit is provided for sensing the level of articles in the hopper and arrangement is made for rendering the detector unit inoperative during preselected times attending the placement of article storage trays atop the hopper.

11 Claims, 4 Drawing Figures

APPARATUS FOR HANDLING ROD-SHAPED ARTICLES

FIELD OF THE INVENTION

This invention relates generally to apparatus for the handling and conveyance of rod-shaped articles and more particularly to apparatus for supplying cigarettes or filter rods to cigarette making machinery.

BACKGROUND OF THE INVENTION

In present-day cigarette manufacture, rods from which filters are ultimately cut, or cigarettes ready for packing, are sometimes stored in trays which are moved into supplying relation to a hopper. The hopper in turn feeds conveyors which issue the rods or cigarettes streamwise to cigarette making, or packing, machinery. This type of apparatus is shown in different aspects in U.S. Pat. Nos. 3,596,787 and 3,759,408. In the first-mentioned patent, a cigarette-filled tray is shown in position atop a hopper, the tray having a removable bottom which is separated from the tray after positioning of the tray atop the hopper. The tray has an open top in such disposition and mechanism in the form of a plate and associated guide and driving members is arranged such that the plate rides interiorly of the tray atop the tray-contained cigarettes whereby the cigarettes in the hopper are caused to maintain a suitable profile. i.e., a generally flat top level as the tray contents become depleted. On this event, the plate operates a switch, whereupon the plate is retracted to a home position permitting manual withdrawal of the emptied tray and insertion of a full tray.

In such manual feeding and removal of storage trays, the mechanism for maintaining rod profile and for sensing tray emptying, while relatively simple, nevertheless includes various parts subject to malfunction and requiring readjustment during use. Thus, the plate is supported and displaced by a jack and the plate need cooperate with spaced vertical guides to maintain levelness. While a single switch is shown in the U.S. Pat. No. 3,596,787 for sensing tray emptying, in typical use a plurality of such switches need be supported for operation by the periphery of the plate.

In the second-mentioned patent apparatus is shown for automated storage tray insertion and removal. A plate mechanism similar to that discussed above is employed in this automated version with the further requirement that, while this mechanism is in substantially upright position while a tray is being emptied, the mechanism need be displaceable from such upright position in the course of operation of the automated tray insertion and removal machinery.

A further version of this type of apparatus is shown in U.S. Pat. Nos. 3,595,413 and 3,718,224.

As is readily observed in factory usage of equipment of the type discussed above, vibration and other environmental disturbances, attendant on the use of conveyor motors, plate member jacks and the like, give rise to the need for frequent adjustment of the equipment, particularly in resetting the various switches involved, in resetting levelness of the plate, etc. As will be evident, elimination of down time, occasioned by such need for readjustment, serves to render the cigarette making process more efficient.

SUMMARY OF THE INVENTION

It is an object of the present invention to provide simplified apparatus for handling rod-shaped articles and maintaining required profiles thereof in the course of feed operations.

It is a more particular object of the invention to provide simplified apparatus incorporating level sensing capacity and maintaining suitable cigarette or rod profile in the course of feeding from storage trays.

In the course of efforts of applicants to achieve desired elimination of the above-discussed plate mechanism in cigarette or rod handling, it became apparent that suitable article profile in the hopper fed by storage trays could not be achieved simply by elimination of the plate member with no compensating additional mechanism. Thus, in the absence of the plate mechanism, on tray emptying, article profile in the hopper varies extensively over the extent thereof giving rise to fouling, e.g., skewing, on addition to the hopper contents of articles contained in a further storage tray. In achieving the foregoing objects, applicants eliminate the plate member and introduce, as compensating mechanism to attain suitable profile, an agitator translatable interiorly of the hopper. With suitable article profile thereby achieved, applicants sense cigarette or rod level in the hopper, and hence storage tray emptying, by simplified non-contiguous sensor apparatus.

The foregoing and other objects and features of the invention will be evident from the following detailed description of the preferred embodiment thereof and from the drawings wherein like reference numerals identify like parts throughout.

DESCRIPTION OF THE PREFERRED EMBODIMENT

Figure 1:
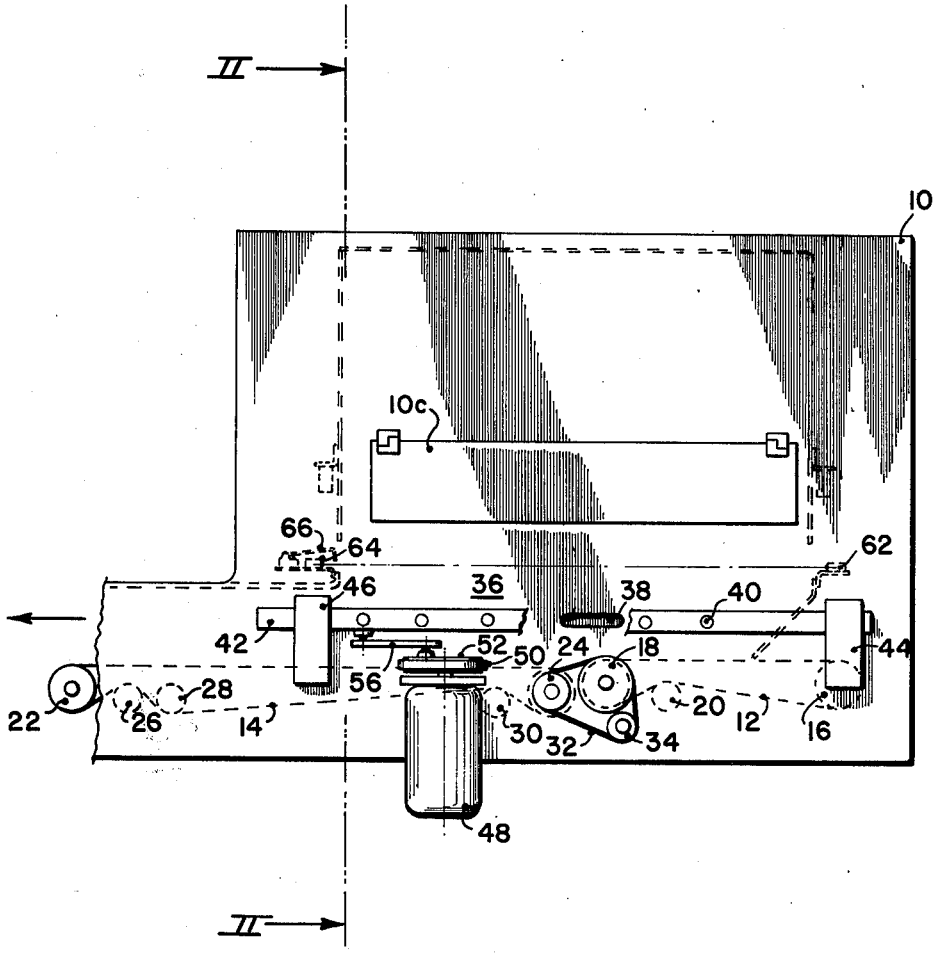
FIG. 1 is an elevational view of article handling apparatus in accordance with the invention.

Referring to FIG. 1 the article handling apparatus of the invention is shown as seen from the rearward side of its wall 10. As in the above-referenced patents, the apparatus includes, in the lower or hopper portion, conveyor belts 12 and 14 arranged in a successive feed relation, the feed direction being indicated by the arrow. Conveyor belt 12 traverses roller 16 and a further roller coupled to pulley 18 and is suitably tensioned by roller 20. Conveyor belt 14 traverses roller 22 and a further roller coupled to pulley 24 and is tensioned by rollers 26, 28 and 30. Pulley 18 may be driven by an electric motor (not shown) and belt 32 engages both pulley 18 and pulley 24, thereby providing for speed differential as between belts 12 and 14. Idler 34 is employed as a tightener for belt 32. Both belt 12 and belt 14 are supported interiorly of hopper 36 on wall 10 with pulleys 18 and 24, belt 32 and idler 34 being situated rearwardly of wall 10 as indicated by the solid line showing thereof in FIG. 1. Belts 12 and 14 are each disposed in article-receiving relation to the outlet of hopper 36.

Wall 10 has a succession of slots therethrough, one being shown at 38. The slots are mutually spaced and extend generally horizontally in the direction of movement of belts 12 and 14. Rod-shaped members 40 (FIGS. 1 and 2) extend through such slots individually into the interior of hopper 36 and are supported for rod-agitating translation by a shuttle bar 42, guided for movement generally parallel to belts 12 and 14 by guide supports 44 and 46. Motor 48 serves as a drive for bar 42 through speed reducing belt 50 and pulleys 52 and 54 and crank pin drive 56.

Figure 2:
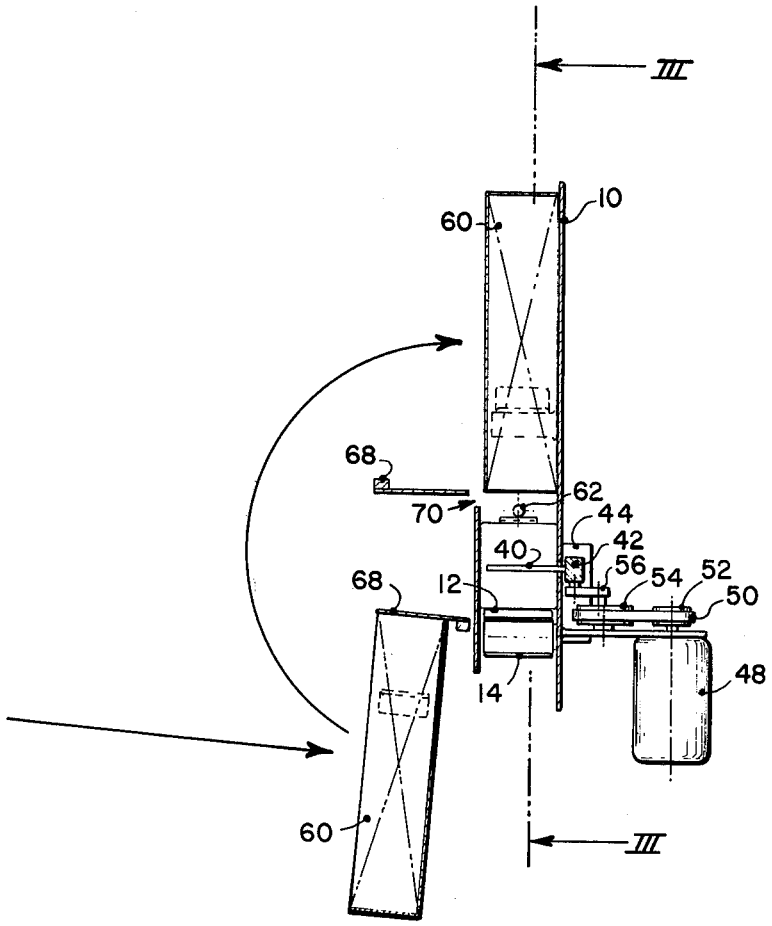
FIG. 2 is a sectional view of the FIG. 1 apparatus as seen from the plane II—II of FIG. 1.
Figure 3:
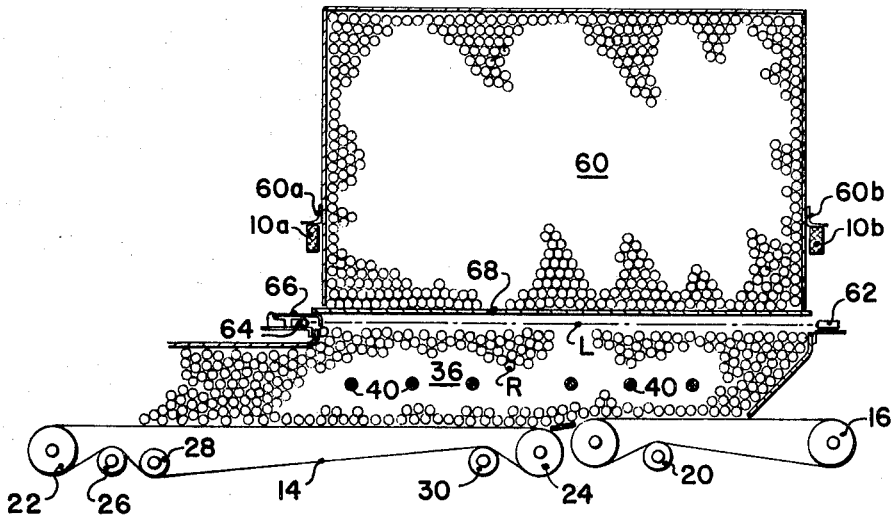
FIG. 3 is a further view of the FIG. 1 apparatus as seen from the plane III—III of FIG. 2 with a storage tray in dispensing position therein.
Figure 4:
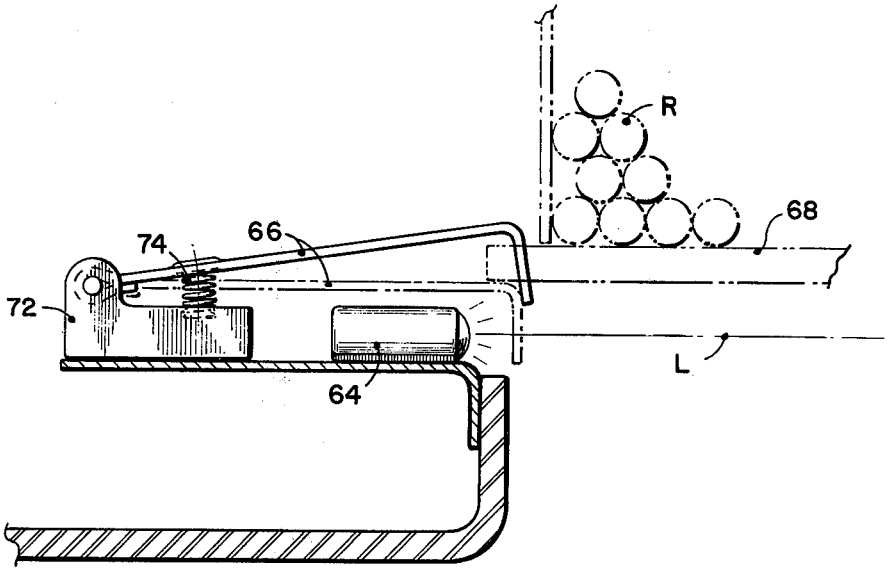
FIG. 4 is an enlarged view of member 66 of FIG. 3 and associated structure.

As is seen in FIGS. 2 and 3, wall 10 holds supports 10*a*, 10*b* engaging end brackets 60*a*, 60*b* for supporting a storage tray 60 immediately atop the inlet of hopper 36. Arranged below such hopper inlet and in line-of-sight (L) relation are light source 62 and light detector 64, which may be a photo resistor. Source 62 propagates a beam of radiant energy generally in the direction of conveyor belt movement and, when the rods contained in hopper 36 and in facing relation to the hopper inlet recede to a level below such line-of-sight L, detector 64 provides output indication of that condition. On this event, automated accessory apparatus, such as noted in the second above-referenced patent may operate responsive to such output indication to remove storage tray 60 and insert a replacement tray as indicated schematically in FIG. 2. Alternatively, the output of detector 64 may operate an audible or visual indicator whereupon an operator may remove the tray and replace it with a full tray. Beam-interrupting member 66 is forced into its position across line L by trap-door 68 (FIGS. 3 and 4) to prevent instant removal of the full tray by an "empty" signal (uninterrupted beam). Removal of the trap-door 68 (FIG. 2) through gap 70 between the tray 60 and hopper 36 releases the rods from the tray and simultaneously allows the beam-interrupting member 66 to be restored by spring 74 to its normal position above line L. FIGS. 3 and 4 show the relation of beam-interrupting member 66 to light detector 64, as well as the pivoted mounting of member 66 on mounting block 72 and its biasing spring 74. The insertion of a tray with trap-door in place depresses member 66 to block the light beam from entering detector 64. Member 66 has a secondary function, to block the gap below the end of the tray so that any rods which move or are pushed against this opening are contained.

For purposes of tray insertion and removal, supports 10*a* and 10*b* (FIG. 1) are separated by a distance slightly exceeding the outer length of the tray. On insertion of a filled tray between these supports, beam-interrupting member 66 is forced into its position above line L upon removal of the typical trap-door 68 (FIG. 2) through slot 70 of such trays.

In its particularly preferred embodiment, the invention contemplates that agitator rod-shaped members 40 be of 4 to 6 millimeters diameter, that slots 38 accommodate a stroke distance of 63 millimeters length and that motor 48 and associated drive members reciprocate bar 42 at between 35 to 55 strokes per minute. Translation of pins 40 is coordinated also with the speed of conveyor belts 12 and 14. In such preferred embodiment under discussion, the surface speed of belt 14 exceeds that of belt 12 by a factor of $1\frac{1}{2}$, with belt 14 traveling at a surface speed of 5.3 i.p.s.

In operation, the agitation provided by members 40 interiorly of hopper 36 provides a raking action through rods R situated in the hopper and is found to provide a substantially flat profile for the rods as shown in FIG. 3 without need for application of any pressure thereto such as by the above-discussed plate mechanism of the referenced patents. Wall 10 may be comprised of separate portions, i.e., an upper portion of translucent plastic permitting direct viewability of the movement of articles in tray 60 and hopper 36 to the level of detector 64, and a lower more rigid, e.g., metallic, portion providing secure support for the agitator assembly and belt drive mechanism. Desirably, wall 10 includes an access door 10*c* (FIG. 1) hingeably supported and openable to provide access to contained articles through the open wall of tray 60 facing wall 10.

As will be appreciated, the agitator assembly and conveyors may be driven from a common drive source, with both thereof being operative and inoperative jointly during storage tray replacement. Alternatively, with independent drive mechanisms for the agitator assembly and conveyor arrangement, such variations may be accommodated as continuous operation of the agitator assembly or selective continuance of operation of the agitator assembly following discontinuance of conveyor operation.

Referring to FIG. 3, by substantially flat profile is meant an upper surface contour, defined by articles in hopper 36, which may vary from a common level but be such as to minimize rolling movement of articles added from a storage tray along such contour to the extent that added articles are skewed with respect to hopper-contained articles.

Various changes and modifications may evidently be introduced in the foregoing embodiment without departing from the invention. Thus, source 62 and detector 64 may have their locations interchanged and may be skewed from the generally transverse relation shown therefor relative to the longitudinal axis of the elongate articles. Translation of members 40 may evidently be other than true horizontal as shown. The function of beam-interrupting member 66 may be performed instead by appropriate electrical circuitry. Thus a time-delay relay in the tray-replacing mechanism may be used to prevent premature tray removal. Also if the replacement is performed manually, as suggested earlier, such precaution is unnecessary. Accordingly, the particularly disclosed embodiment is intended in an illustrative and not in a limiting sense. The true spirit and scope of the invention is set forth in the following claims.

What is claimed is:

1. Apparatus for handling rod-shaped articles comprising a hopper having an inlet for receiving said articles and an outlet, conveyor means supported in article-receiving relation to said hopper outlet, agitator means supported for translation in said hopper in the direction of movement of said conveyor means for providing a substantially flat profile for articles in said hopper in facing relation to said hopper inlet, support means for receiving a storage tray containing said articles and supporting said tray in article-issuing relation to said hopper inlet, detector means in said hopper for providing output indication when said articles in said hopper in facing relation to said hopper inlet are disposed at a predetermined level therein, and interrupting means selectively engageable by said storage tray and thereupon preventing said detector means from providing said output indication.

2. The apparatus claimed in claim 1 wherein said storage tray includes a member removable therefrom to dispense said articles from said tray to said hopper inlet and wherein said interrupting means comprises a biased element engaged by said removable member on said supporting of said tray in article-issuing relation to said hopper.

3. The apparatus claimed in claim 2 wherein said detector means comprises a radiant energy source propagating an output beam and a detector supported in the path of said beam, said biased element being movable on such engagement thereof by said removable member into a position between said light source and said detector and being further movable from such position on removal of said removable member from said storage tray.

4. Apparatus for handling rod-shaped articles comprising a hopper having an inlet for receiving said articles and an outlet, conveyor means supported in article-receiving relation to said hopper outlet, agitator means supported for translation in said hopper in the direction of movement of said conveyor means for providing a substantially flat profile for articles in said hopper in facing relation to said hopper inlet, and detector means in said hopper for providing output indication when said articles in said hopper in facing relation to said hopper inlet are disposed at a predetermined level therein, said detector means comprising a radiant energy source propagating an output beam and a detector supported in the path of said beam, said apparatus further including a beam-interrupting member selectively movable into a position between said light source and said detector.

5. Apparatus for handling rod-shaped articles comprising a hopper having an inlet for receiving said articles and an outlet, conveyor means including plural conveyors arranged in successive feed relation, each such conveyor being supported in article-receiving relation to said hopper outlet, agitator means supported in said hopper for providing a substantially flat profile for articles in said hopper in facing relation to said hopper inlet, support means for receiving a storage tray containing said aricles and supporting said tray in article-issuing relation to said hopper inlet, and detector means in said hopper for providing output indication when said articles in said hopper in facing relation to said hopper inlet are disposed at a predetermined level therein, said detector means comprising a radiant energy source propagating an output beam and a detector supported in the path of said beam, said apparatus further including a beam-interrupting member selectively movable into a position between said light source and said detector.

6. Apparatus for handling rod-shaped articles comprising a hopper having an inlet for receiving said articles and an outlet, conveyor means including plural conveyors arranged in successive feed relation, each such conveyor being supported in article-receiving relation to said hopper outlet, agitator means supported for translation in said hopper in the direction of movement of said conveyor means for providing a substantially flat profile for articles in said hopper in facing relation to said hopper inlet, support means for receiving a storage tray containing said articles and supporting said tray in article-issuing relation to said hopper inlet and detector means in said hopper for providing output indication when said articles in said hopper in facing relation to said hopper inlet are disposed at a predetermined level therein, said detector means comprising a radiant energy source propagating an output beam and a detector supported in the path of said beam, said apparatus further including a beam-interrupting member selectively movable into a position between said light source and said detector.

7. Apparatus for handling rod-shaped articles comprising a hopper having an inlet for receiving said articles and an outlet, conveyor means supported in article-receiving relation to said hopper outlet, a wall of said hopper having a plurality of slots extending therethrough, said slots being spaced successively in the direction of movement of said conveyor means, agitator means comprising a plurality of rod-shaped members, each such rod-shaped member extending into said hopper through a distinct one of said slots, drive means imparting translation to said rod-shaped members, support means for receiving a storage tray containing said articles and supporting said tray in article-issuing relation to said hopper inlet and detector means in said hopper for providing output indication when said articles in said hopper in facing relation to said hopper inlet are disposed at a predetermined level therein, said detector means comprising a radiant energy source propagating an output beam and a detector supported in the path of said beam, said apparatus further including a beam-interrupting member selectively movable into a position between said light source and said detector.

8. The apparatus claimed in claim 7 wherein said support means includes a wall, said tray having an open wall juxtaposed with said support means wall on such storage tray insertion, said support means wall being openable to permit access to the interior of said storage tray.

9. The apparatus claimed in claim 8 wherein such inserted storage tray includes a closure member in facing relation to said hopper inlet, said closure member being removable from said storage tray whereby articles therein may be dispensed into said hopper.

10. The apparatus claimed in claim 7 wherein said conveyor means includes a first conveyor in article-receiving relation to said hopper outlet and in article-issuing relation to article user equipment and a second conveyor in article-receiving relation to said hopper outlet and in article-feeding relation to said first conveyor, said apparatus further including means for moving said first conveyor at a greater surface speed than said second conveyor.

11. The apparatus claimed in claim 10 wherein said means moves said first conveyor at a surface speed approximately 1.5 times the surface speed of said second conveyor.

* * * * *